United States Patent [19]

Vandame

[11] Patent Number: 4,655,527

[45] Date of Patent: Apr. 7, 1987

[54] CONNECTOR APPARATUS

[75] Inventor: Bertrand Vandame, Villepreux, France

[73] Assignee: Precision Mecanique Labinal, Bois d'Arcy, France

[21] Appl. No.: 816,626

[22] Filed: Jan. 6, 1986

[30] Foreign Application Priority Data

Jan. 14, 1985 [FR] France ..... 85 00458

[51] Int. Cl.[4] ..... H01R 13/627

[52] U.S. Cl. ..... 339/91 R

[58] Field of Search ..... 339/91 R

[56] References Cited

U.S. PATENT DOCUMENTS

| | | | |
|---|---|---|---|
| 3,409,858 | 11/1968 | Krehbiel | 339/91 R |
| 3,829,821 | 8/1974 | Derr et al. | 339/91 R |
| 3,860,316 | 1/1975 | Hardesty | 339/91 R |
| 4,324,449 | 4/1982 | Watanabe et al. | 339/91 R |
| 4,359,257 | 11/1982 | Lopinski et al. | 339/99 R |
| 4,441,776 | 4/1984 | Anhalt | 339/91 R |

FOREIGN PATENT DOCUMENTS

| | | | |
|---|---|---|---|
| 533931 | 12/1983 | Australia . | |
| 642850 | 5/1964 | Belgium | 339/91 R |
| 2210844 | 9/1973 | France | 339/91 R |

*Primary Examiner*—John McQuade

*Attorney, Agent, or Firm*—Sandler & Greenblum

[57] ABSTRACT

A fastening device made up of at least two elements which may be adapted to accommodate complementary electrical connection devices and which are provided with connector assemblies which include an elongate member associated with a first element having flexible lateral sides provided with bosses and an upper surface side provided with a lug which interact with rims bordering an opening in a housing formed as part of a second element which are adapted to mate with each other in a locking arrangement.

43 Claims, 11 Drawing Figures

FIG.7
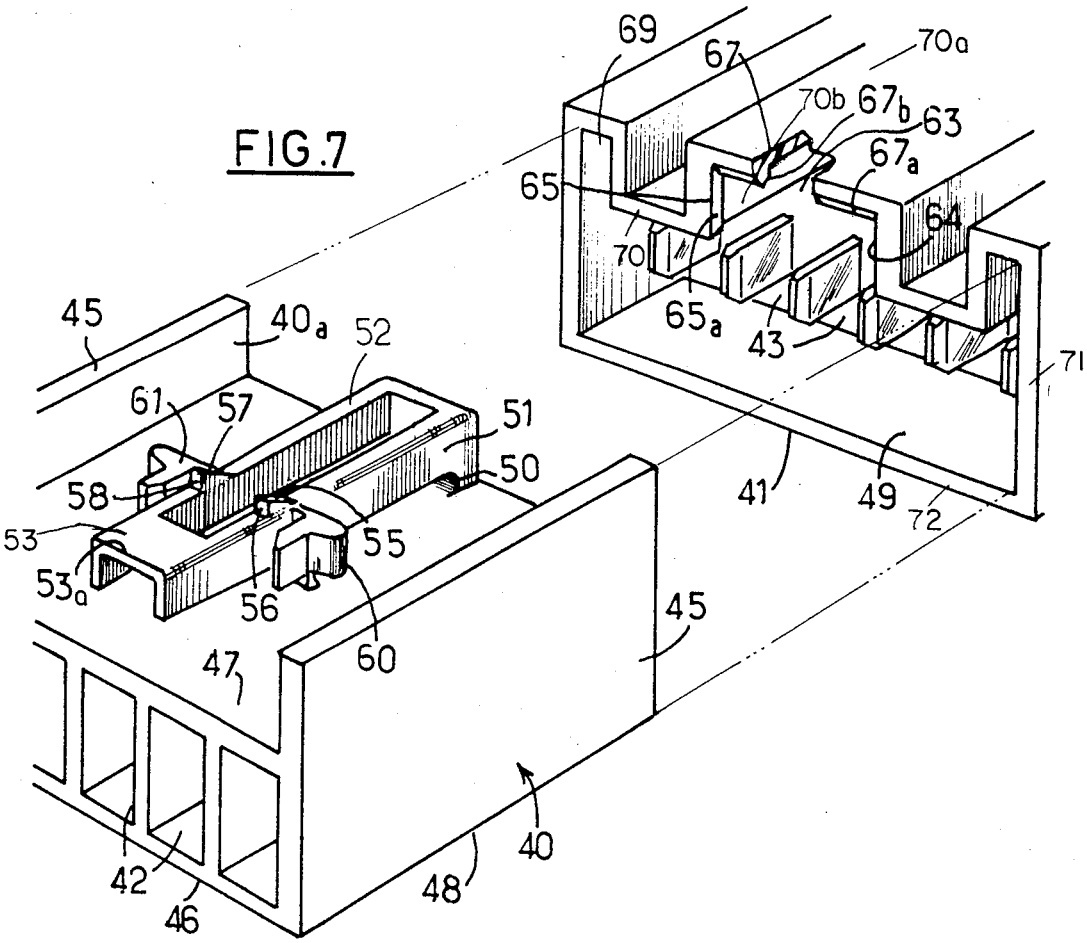
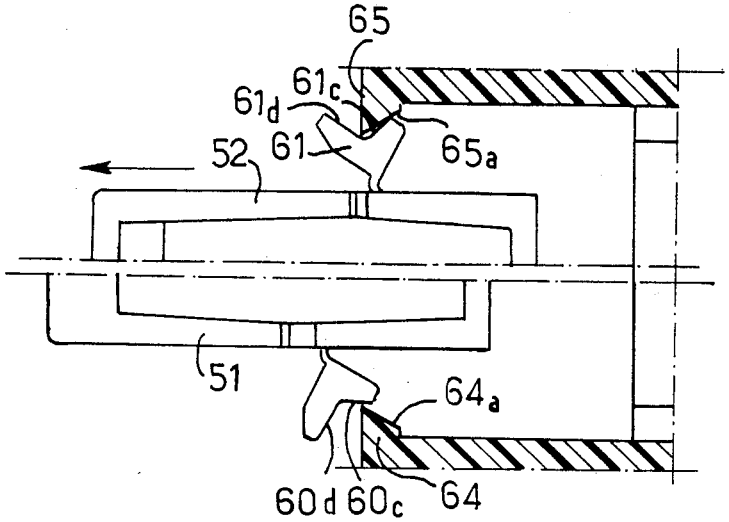
FIG.11

CONNECTOR APPARATUS

BACKGROUND OF THE INVENTION

1. Technical Field of the Invention

The present invention relates to a fastening device including a first male member adapted to engage a second female member in a locking assembly. More particularly, the present invention is directed to electrical connection boxes including a first element having either male or female electrical connections or conduits, which is designed to engage a cavity in a second element, associated with connection devices complementary to those associated with the first element, which are designed to function as locking devices for holding the two elements firmly together when one has been fitted into the other. The present invention is also directed to the connector or fastening devices for such electrical connection boxes, particularly fastening devices which automatically secure one member in an other member after a certain amount of force has been applied to insert the one member into the other member.

2. Discussion of Background Information

A number of electrical connection boxes of this general type are known wherein the locking action is effected by means of elastic or spring-type devices associated with one of the elements which interact with complementary devices associated with the other element when one element has been inserted wholly or partially into the other. In such conventional connection boxes, additional pressure to overcome the resistance of the elastic locking device or twisting action must normally be exerted at the end of the sliding movement of one of the elements into the other to ensure the interlocking of the two elements. If, however, this final additional force is not properly exerted, a firm locking engagement of the elements together often is not effected. The present invention has been developed to solve this problem commonly associated with conventional connection boxes.

SUMMARY OF THE INVENTION

The present invention is directed to a fastening device including a first element adapted to be connected to a second element, with the first element including an elongate member having flexible, lateral sides provided with bosses having exterior edges positioned along an intermediate portion of the lateral sides, and an upper surface side provided lugs located adjacent the bosses, and a second element adapted to be connected to the first element, which includes a hollow member having a front face provided with an opening bordered by opposite side rims spaced apart by a distance at least as great as the width between the lateral sides of the elongate member, but less than the distance between the exterior edges of the bosses adapted to interact with the bosses, and an upper rim adapted to interact with the lugs to fasten the first element and the second element together when the elongate member is inserted into the hollow member so that the bosses and the lugs pass by said rims.

In particular, the present invention is directed to a fastening device, as generally described above, wherein the lugs have a front surface and a rear surface, with the front surface of the lugs forming an oblique angle with the upper surface side of the lateral sides of the first element of the fastening device and the rear surface forms a face which is essentially perpendicular to the upper surface side of the lateral sides of the elongate member of the fastening device, and preferably wherein the bosses have a front surface and a rear surface which incline in opposite directions towards each other and form an oblique angle with each of the lateral sides of the elongate member of the fastening device.

In a preferred embodiment of the present invention, the bosses of the fastening device are attached to the lateral sides of the elongate member by hinges, and preferably wherein each are composed of a front wing portion having an exterior surface and an interior surface, and a rear wing portion having an exterior surface and an interior surface, connected so as to form an acute angle between the interior surface of the front wing portion and the interior surface of the rear wing portion, so that the exterior surface of the front wing portion abuts against a respective one of the opposite side rims and the exterior surface of the rear wing portion abuts against a respective one of the lateral sides of the elongate member causing the lateral sides to bend inwardly towards each other to permit the bosses to pass by the rims bordering the opening in the hollow member of the second element of the fastening device.

The present invention is also directed to a fastening device, as generally described above, wherein the hollow member of the second element of the fastening device is a housing made up of opposite lateral side portions connected to opposite lateral rims bordering the opening in the front face and an upper portion connected to the upper rim bordering the opening in the front face with the portions of the housing extending rearwardly away from the front face of the housing for a distance defining the depth of the housing, preferably wherein the length of the elongate member of the first element is greater than the depth of the housing of the second element so that the rear end of the elongate member remains outside the housing when the elongate member is inserted into the housing.

The present invention is directed still further to a fastening device, as described above, wherein the upper rim bordering the front face of the hollow member has a chamfered lower edge facing outwardly and sloping downwardly from the opening to meet with an inner side of the upper rim, and preferably wherein the opposite side rim bordering the opening have chamfered edges sloping away from the opening in the outer side of the front face.

The present invention is also directed to a fastening device, generally described above, wherein the lateral sides of the elongate member of the first element are separated from each other by a space, preferably wherein the intermediate portion of the lateral sides is narrower than the remaining portion of the lateral sides, and in particular wherein the elongate member is generally U-shaped with two longitudinally extending branch portions having exterior sides and interior sides connected to a transverse base part, wherein the exterior sides of the branch portions form the lateral side of the elongate member and wherein the base part forms the rear end of the elongate member.

In accordance with the present invention, a fastening device is provided, as described above, wherein the first element further includes a base member having a support surface and a means to support the elongate member attached at one end to the elongate member and at another end to the support surface, preferably wherein the means to support is attached at the front end to support the elongate member in a cantilever fashion, and wherein the base member also includes two side walls attached to the support surface and connected to a base surface located below the support surface to define an open-ended cavity, preferably further including at least one interior wall extending between the support surface and the base surface and positioned parallel to the side walls to divide the cavity into at least two channels, wherein the base member is also provided with a rear plate having openings into these channels.

In addition, the present invention is directed to a fastening device, as described above, wherein the second element also includes a bottom portion including a floor, two lateral walls connecting the floor with an upper surface to define an open-ended cavity, with the hollow member being formed in the upper surface, preferably wherein the distance between the two lateral walls and the distance between the floor and the upper surface are, respectively, greater than the distance between the two side walls and the distance between the support surface and the base surface so as to permit the base member to nest within the bottom portion, and preferably wherein the first element and the second element are associated with complementary electrical devices.

A preferred embodiment of the present invention is an electrical connector device including a first element attached to one component of an electrical device, and adapted to be connected to a second element, with the first element including a base member having a support surface with a front end and a means to support extending perpendicularly from the support surface in the vicinity of the front end, and an elongate member having an end attached to the means to support with flexible side components spaced apart by a distance, each having an exterior lateral side provided with a boss having an outer edge, and an upper surface side provided with a lug located adjacent to the boss, and a second element attached to another component of an electrical device, adapted to be connected to the first element, including a housing having opposite side portions, upper portions extending between the side portions and a front face provided with an opening bordered by opposite side rims connected to the opposite side portions, with the opposite side rims being spaced apart by a distance at least as great as the distance between exterior lateral sides of the side components, but less than the distance between outer edges of the bosses provided on the exterior lateral sides, so as to adapt the opposite side rims to interact with the bosses, and an upper rim connected to the upper portion, with the upper rim being adapted to interact with lugs located on the upper surface side of the lateral sides whereby the interaction between the bosses and the opposite side rims and the lugs and the upper rim serve to connect the first element and the second element together when the elongate member is inserted into the housing in such a manner that the bosses and the lugs pass by the rims to become seated within the housing.

BRIEF DESCRIPTION OF THE DRAWINGS

FIG. 7 is a perspective view of a constructional variant of the present invention.

FIGS. 8, 9, 10, and 11 are plane views with partial sections showing the operation of the locking mechanism according to the embodiment illustrated in FIG. 7.

DETAILED DESCRIPTION AND PREFERRED EMBODIMENTS

Figure 1:
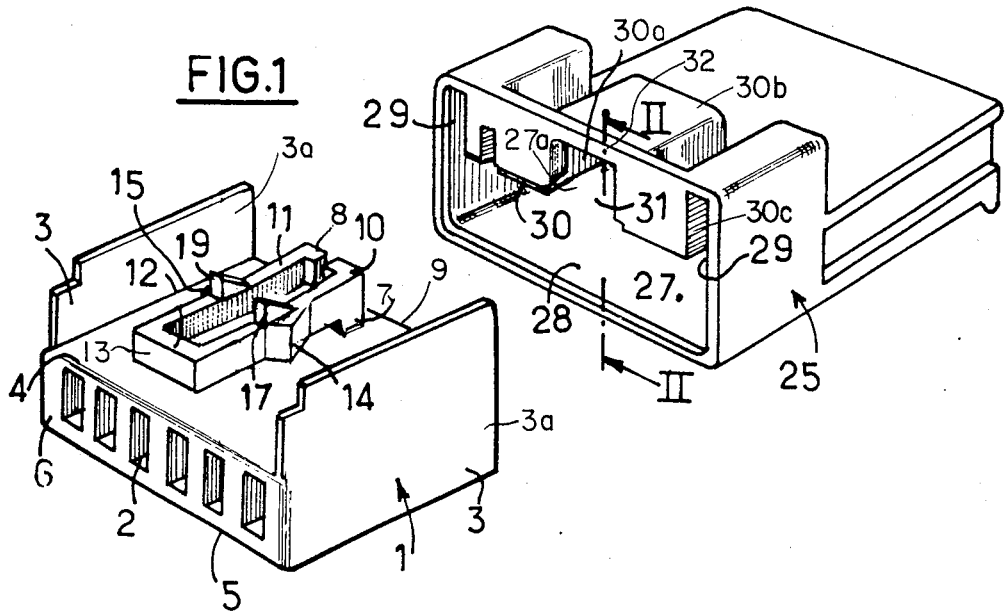
FIG. 1 is an exploded view, in perspective, of an electrical connection box according to the invention.
Figure 2:
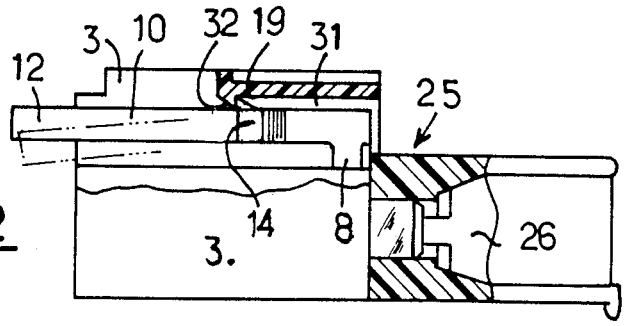
FIG. 2 is a section along lines II—II of FIG. 1.
Figure 3:
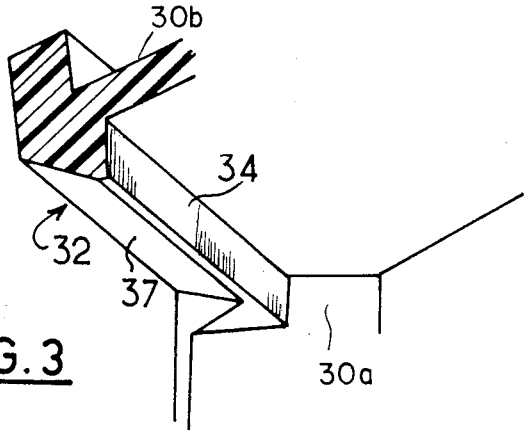
FIG. 3 is a view in perspective and on a larger scale of part of the element shown in FIG. 2.
Figure 4:
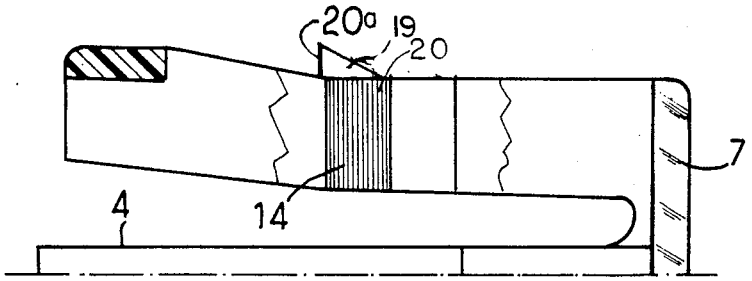
FIG. 4 is a sectional along line IV—IV of FIG. 5.

The present invention relates to electrical connection boxes of the type including a first element designed to accommodate electrical conduits and to engage a second element, also designed to accommodate electrical conduits which are complementary to those of the first element.

In one embodiment of the present invention, the first element is provided with an elastic or spring-type locking device including a deformable elastic or spring-type stirrup or clasp which has a general U-shape with the free ends of the branches of the clasp being provided with an extended portion or means to support in the form of a pillar in such a way that the entire clasp may be depressed along its lateral sides, starting from the pillar to move the branches closer together. Each branch of the clasp is also provided with a projection from each of its lateral sides and a lug which is provided along an adjacent upper side of the clasp. The second element is provided with a housing having a cavity adapted to accommodate the clasp. In this embodiment, the housing is provided with a front face having an opening bordered by a rim designed to interact with the lug and two opposite rims designed to interact with the projections. Accordingly, insertion of the first member into the second member causes the lug and projections on the clasp to contact the rims around the opening in the front face of the housing which slope so as to guide the clasp into the cavity. This occurs first by causing the clasp to move to one side and thereafter, upon contact with the projections positioned intermediate along the branches of the clasp, to move the intermediate portion of the lateral sides of the clasp closer together until insertion of the clasp has progressed past the rims. When this occurs, the branches spring back to their original configuration whereby the lugs and the projections align with the interface of the rim.

As a result of the unique arrangement of the locking device of the present invention, the force required to unlock the clasp from its seated position within the housing before removing the clasp from the cavity is substantially greater than the force required to insert the clasp into a locking arrangement with the housing.

Further refinements to the basic locking device of the present invention can be made by designing the lug to have an inclined portion sloping upwardly away from the second member in the general form of a ramp which terminates with a face which is essentially perpendicular to the longitudinal axis of the branches of the clasp and may be reinforced with a relatively durable material, such as steel.

According to a further modification, the rim of the housing of the second member which is designed to interact with the lug has one face turned towards the outside in the form of an inclined surface or ramp which terminates in an inner face essentially perpendicular to the upper wall of the housing so that the face of the lug can fit flush when engaging the inner face of the rim of the housing.

In another modification of the present invention, the opposite rims positioned essentially perpendicular to the rim of the housing designed to interact with the lug are chamfered or bevelled to slope inwardly in the form of a ramp towards the inner face of the wall of the housing.

Another feature of the present invention is the provision of projections extending outwardly from each lateral side of the elongate member in an area intermediate along each branch of the clasp, preferably wherein two of the sides of the projection incline towards each other in respective planes which intersect. The slope of the surface of the projection towards the rear of the clasp is preferably such that it complements the slope of the chamferred or bevelled inclined surface of the opposite rims of the housing for ease of insertion of the clasp into the housing.

The fastening device of the present invention is preferably constructed in such a manner that the clasp is longer than the cavity defined by the housing so that an end of the clasp always remains outside the cavity when the clasp is otherwise locked into position within the cavity of the housing. This is important for the separation of the elements from each other. To do so, one merely grasps the rearward or trailing end of the clasp and depress or squeeze the two branches of the clasp together to an extent so that the outer edge of the projection will fit between the opposite rims of the opening in the face of the housing whereby the clasp can be completely disengaged and removed from the cavity of the housing.

As another feature of the present invention, the projections may be made up of latches connected by hinges to the lateral sides of the branches of the clasp to permit the latches to tilt elastically or pivot reciprocally as the clasp passes by the opposite rims bordering the opening in the face of the housing. Preferably, each latch is formed to have two wing portions forming an angle between them and positioned so that when the first member is inserted in the cavity of the second member, one of the winged portions abuts against a rim of the housing while the other wing portion bears against the corresponding branch of the clasp thereby causing the branch of the clasp to bend inwardly to a sufficient extent to permit passage of the clasp between the rims and into the cavity of the housing in such a manner that the rims are seated in the space between the respective wing portions of the latch. This latter embodiment provides a locking system in which the force necessary to insert the members is continuous until a locking arrangement is achieved but which offers the advantage of requiring relatively little force at all to disconnect the members from each other.

The invention will now be described in greater detail by reference to particular embodiments given solely by way of non-limiting examples as illustrated in the attached drawings.

In the embodiment shown in FIGS. 1–6, an electrical box of a multi-track type is shown. The electrical connection box includes a first element 1. The first element 1 is shown as having generally parallelepipedal shape defined by two sidewalls 3, an upper wall 4, a lower wall 5 and a base wall or rear plate 6. The plate 6 of element 1 is preferably provided with a plurality of openings 2 into channels or cavities within the first element 1. These cavities may be designed to receive an appropriate device connected to electrical conductors. An elongate member or clasp 12 of the connector device of the present invention is preferably positioned within the central area of upper wall 4 between sidewalls 3 and is preferably attached to upper wall 4 by means to support in the form of two pillars 7 and 8 which are integral with or attached to branches 10 and 11 of the clasp. The construction of the clasp is such that branches 10 and 11 are otherwise unsupported as they extend longitudinally in the rearward direction to join base portion 13 in a cantilever-fashion. Each of the branches of the clasp is essentially a mirror image of the other. As shown in FIG. 1, a projecting portion or boss 14 extends outwardly from the lateral side of branch 10 and includes a surface **14*a* sloping upwardly from pillar 7 and a surface 14*b* sloping downwardly in the opposite direction to join the lateral side of branch 10. The upper portions of the inclined surfaces 14*a* and 14*b* meet at edge 14*c* which forms the apex of the projecting portion or boss 14. The branch 11 is symmetrical to the branch 10 with respect to a medium plane and is similarly provided with a projecting portion 15 having inclined portions 15*a* and 15*b* separated by edge 15*c*** at the apex of the projecting portion.

Figure 5:
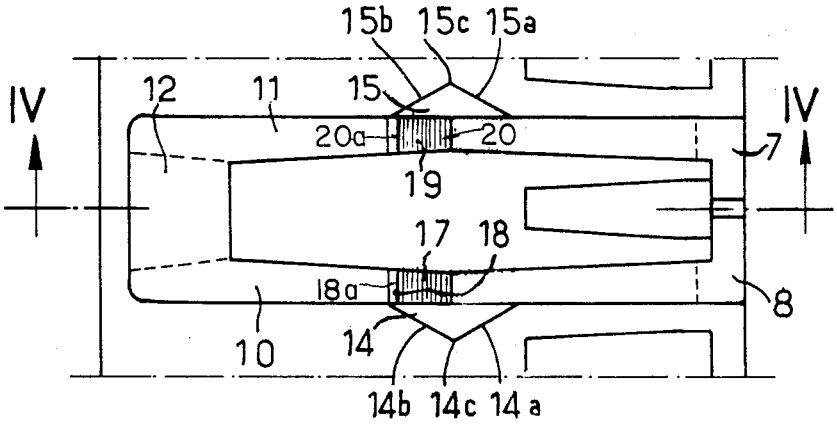
FIG. 5 is a plane view of part of a box element.
Figure 6:
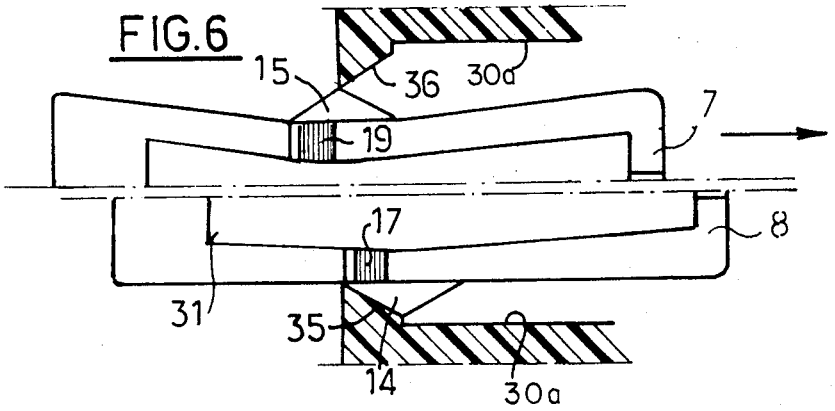
FIG. 6 is a schematic diagram of the operation of the locking device.

As shown more clearly in FIG. 5, each of branches 10 and 11 narrows in width in the general area adjacent the projecting portions 14 and 15 in order to increase the elasticity or flexibility of the branches. In this same general area, lugs 17 and 19 are provided on the upper side surface adjacent the lateral sides of branches 10 and 11 provided with projecting portions 14 and 15. These lugs extend from the upper side surfaces of the branches essentially perpendicular to the direction which the projecting portions extend from the lateral sides of the branches. Each of these lugs has a gradually sloping surface 18, 20 inclined upwardly to form an oblique angle with the upper side surface of the branch on which the lug is provided in a direction away from pillars 7 and 8 to join a surface which drops very abruptly to form a face which is perpendicular to the upper side surface of the branch.

The second element may be designed to include a plurality of tracks 26 corresponding to the channels or cavities provided in element 1 having openings 2. Each track 26 is designed to accommodate an electrical connection device or conduit which is adapted to interact with a complimentary electrical connection device or conduit which is positioned within the channels or cavities of element 1. The electrical connection devices which may be used in conjunction with elements 1 and 25 of the present invention may in turn be connected to conductors in an electric circuit. Inasmuch as the electrical connection devices which may be used with the connector device of the present invention are conventional, they do not make up a part of the present invention and are not shown in the accompanying drawings.

Referring again to FIG. 1, element 25 has an open front face 24 which exposes cavity 27 designed to engage the corresponding front face 9 of element 1 as element 1 is inserted into element 25. The cavity 27 is defined by a lower wall 28 which extends between and connects side walls 29 which in turn are connected to upper wall 30. In its span between side walls 29, the upper wall 30 forms a housing, as further described below, to define a cavity for accommodating clasp 13 of element 1. The cavity 27 defined by walls 28, 29 and 30 of element 25 is just large enough to accommodate the corresponding walls 5, 3 and 4 of the base portion on which clasp 13 is positioned when element 1 is inserted into element 25. Accordingly, each of the walls of element 1 slide along and nest against a corresponding wall of element 25 as the elements are brought together in a locking arrangement.

The upper wall 30 which extends between side walls 29 of element 25 is shaped in such a way as to form housing 31 including side portions 30*a* and upper portion 30*b*. The housing 31 is bordered around its front face by a rim 32 having a chamferred or bevelled edge to form a ramp 37 sloping inwardly towards the cavity defined by the housing to meet the inner face 34 of the rim which is essentially perpendicular to the upper portion 30*b* of the housing. The two side portions 30*a* of housing 31 are separated by a distance corresponding to the space between the edges 14*c* and 15*c* of projecting portions or bosses 14 and 15, respectively, when branches 10 and 11 of clasp 12 are in their relaxed state. The side portions 30*a* of the housing terminate in opposite lateral rims 35 and 36 having chamfered or bevelled edges which slope inwardly towards side portions 30*a* in such a manner that the front opening has a width corresponding to the distance separating the exterior lateral sides of branches 10 and 11 when the branches are in a relaxed state. The length of clasp 12 is greater than the depth of the housing 31 so that when the elements 1 and 25 are connected together at least a portion of the clasp will remain outside of housing 31.

In operation, when the box element 1 is inserted into the cavity 27 of the complimentary element 25, the clasp 12 enters the cavity defined by housing 31. In so doing, the branches 10 and 11 of the clasp 12 pass through the opening in the front face of the housing bordered by rims 35 and 36 while the upper side surface of the clasp 12 passes by the edge of the upper rim 32. Inasmuch as the width between the rims 35 and 36 of the opening into housing 31 is just great enough to permit the entrance of branches 10 and 11 of the clasp, a greater force must be exerted on the clasp at the point where inclined surfaces 14*a* and 15*a* of projecting portions or bosses 14 and 15 contact rims 35 and 36, respectively, in order to continue the insertion of the clasp into the housing so as to fasten the two elements together. The force must be sufficient to depress the branches 10 and 11 towards each other to an extent sufficient to permit the passage of the bosses 14 and 15 past rims 35 and 36 of the front face of the housing. The inclined surfaces 14*b* and 15*b* of the bosses then become flush with the sloped edges of rims 35 and 36 as element 1 becomes securely nested into cavity 27 of element 25. As this is occurring, lugs 17 and 19 contact upper rim 32 bordering the opening in the front face of the housing and force the trailing end 13 of the clasp to slope down towards the upper wall 4 of element 1 to a degree sufficient to permit passage of the lugs into the cavity 27*a* of housing 31. When the clasp has been inserted into cavity 27*a* so that the inclined surfaces of lugs 17 and 19 pass over the inclined surface 37 of rim 32, the rearward surfaces 18*a* and 20*a* of lugs 17 and 19 fit flush against the inner face of rim 32 to firmly seat clasp 12 within housing 31.

When it becomes necessary or desired to separate the two box elements 1 and 25, all that is required is to apply the appropriate pressure to the exposed end 13 of clasp 12 so as to disengage the faces 18*a* and 20*a* of lugs 17 and 19 from the inner face 34 of rim 32 and to pull elements 1 and 25 with the sufficient amount of force so that the bosses 14 and 15 will depress branches 10 and 11 together to a sufficient extent to permit the edges 14*c* and 15*c* to pass through the opening between rims 35 and 36 of housing 31.

In FIGS. 7–11, an embodiment of the present invention is illustrated which is preferred because the operation of disassembling the box elements does not require as much force as needed to assemble them together.

In this regard, FIG. 7 shows a connector box element of the preferred embodiments corresponding in general to the elements shown in FIG. 1. In this embodiment, however, the male element and the female element are designated as 40 and 41, respectively. In a manner similar to the previously described embodiment, element 40 includes a series of channels or cavities 42 each of which is adapted to accommodate an electrical conduit with the element 41 including a corresponding number of channels or tracks 43 also adapted to accommodate an electrical conduit capable of interacting with the electrical conduit in channel 42 of element 40. Although the electrical conduits associated with channels 42 may be male and those electrical conduits associated with channels 43 may be female, the reverse arrangement would be equally suitable. Inasmuch as the electrical conduits or connection devices used in this instance may be of any conventional design, they do not form a part of the present invention and are not shown in the accompanying drawings.

The element 40 is of a generally parallelepipedal shape and includes two side walls 45, an upper wall 47 and a lower wall 48. The box element 41 includes an upper wall 70, two side walls 71, and a lower wall 72 defining a cavity 49 having sufficient dimensions to accommodate box element 40 in a manner similar to elements 1 and 25 in the previously discussed embodiment illustrated in FIGS. 1–6.

A clasp 53 is attached to the upper wall 47 in the vicinity of the end opposite base plate 46 by a support 50 extending between two branches 51 and 52 of the clasp towards upper wall 47. The branch 51 is provided on its upper surface side with a lug 55 having a similar shape and construction to lug 19. In this regard the lug has a surface which slopes as a ramp upwardly away from support 50 to a predetermined height and then terminates abruptly with a face 56 essentially perpendicular to the upper surface side of branch 51. The branch 52 has an identically similar lug 57 having face 58.

The branches 51 and 52 are elastically or flexibly deformable and also have a narrowed portion in an intermediate area along their extent in order to increase their flexibility. The branch 51 is provided on its exterior lateral side with a latch 60 which functions generally in the same manner as projecting portion 14 on branch 11 in the previously discussed embodiment. In this instance, however, the latch 60 is connected to the exterior lateral side of latch 51 by a flexible portion or hinge 60*a* and is constructed to have two winged portions 60*c* and 60*d* forming an angle between them. The external face 60*b* of the wing 60*c* is preferably constructed as an extension of flexible portion 60*a* while the external face 60*e* of the wing 60*d* extends in the direction substantially perpendicular to flexible portion 60*a*. An identically similar latch 61 is provided on the branch 52. This latch 61 has portions 61*a*, 61*b*, 61*c*, 61*d* and 61*e*, corresponding to the portions 60*a*–60*e*, respectively, of the latch 60.

The cavity 49 in the element 41 is defined by upper wall portions 70*a* and side wall portions 70*b* of housing 63. The front face of housing 63 is bordered by rims 64, 65 and 67. The exterior face of rims 64 and 65 are situated in the plane of the opening and communicate with the internal face of the side wall 70*a* and 70*b* by chamferred or bevelled edges which slope inwardly towards the side walls. The upper rim 70 of the housing 63 is configured much in the same way as rim 32 shown in FIG. 3. In this regard, rim 67 is provided with a chamfered or bevelled edge 67*b* which slopes at an incline downwardly into the cavity of the housing to connect to an inner face of the rim which is essentially perpendicular to upper wall 70*a* of the housing. In a manner similar to the previous embodiment, the distance between rims 64 and 65 is greater than the width of the clasp 63 with its lateral sides in a relaxed state, but smaller than the space between the extreme ends of the wing portion 60*c* and 61*c*.

Figure 8:
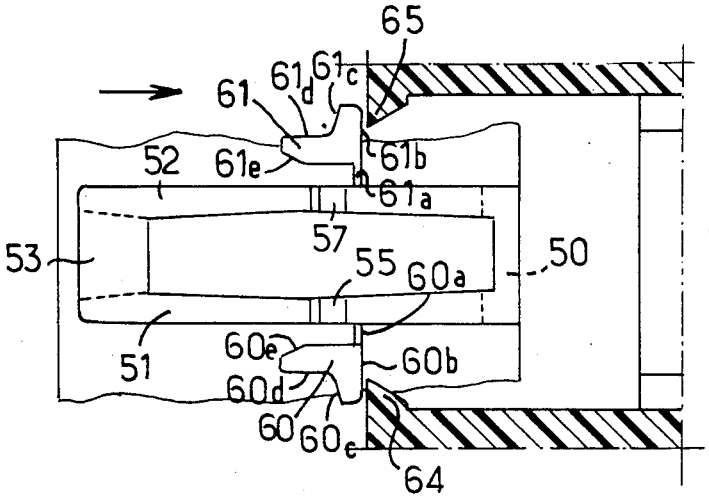
Figure 9:
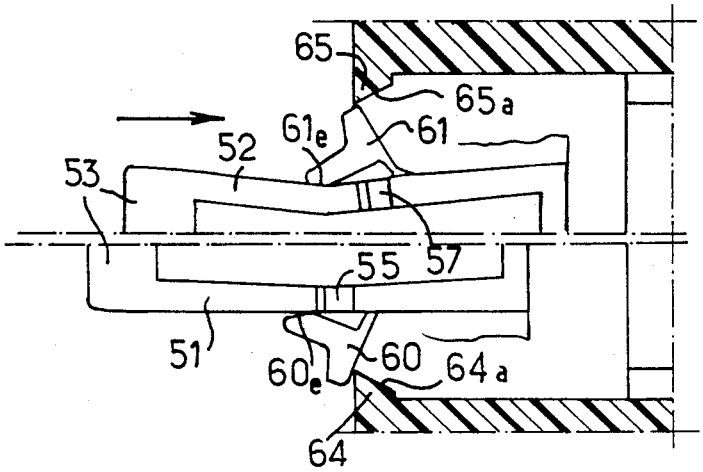
Figure 10:
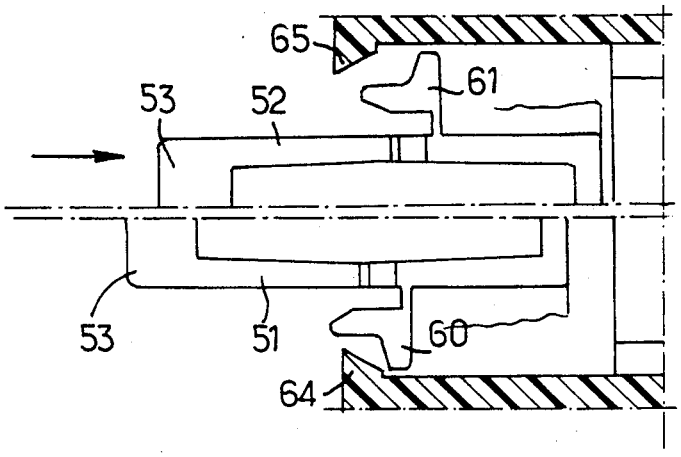

The manner by which the connector apparatus illustrated in FIG. 7 may be connected and disconnected is shown more clearly in the schematic diagrams of FIGS. 8–11. Referring first to FIG. 8, element 40 is inserted into cavity 49 of housing 63 to an extent where the latches 60 and 61 contact rims 64 and 65. The initial contact of latches 60 and 61 is made by the faces 60*b* and 61*b* of winged portions 60*c* and 61*c*. Turning to FIG. 9, as more force is used to connect elements 40 and 41 together, latches 60 and 61 are caused to move rearwardly by pivoting about flexible portions or hinges 60*a* and 61*a* which causes the external face of wing portions 60*e* and 61*e* to press against the exterior lateral sides of branches 51 and 52, respectively. This causes the branches 51 and 52 to flex inwardly towards each other so as to permit the passage of exterior faces 60*b* and 61*b* past rims 64 and 65 of housing 63. When this has been accomplished, latches 60 and 61 pivot back to their normal position, and branches 51 and 52 return to their natural or relaxed state due to the elasticity and flexibility of these elements. As the latches 60 and 61 begin to make contact with rims 64 and 65, lugs 55 and 57 begin to contact the chamfered edge of rim 67. As the clasp 53 is inserted deeper into the cavity of housing 63, the inclined surfaces of lugs 55 and 57 press against the chamfered edge of rim 67 with increasing force which causes the clasp to bend downwardly towards upper wall 47 of element 40 to a degree which permits the passage of lugs 55 and 57 through rims 67 into the cavity of housing 63. Once the inclined surfaces of lugs 55 and 57 have passed by rim 67, there is a release of pressure on clasp 53 which then flexes back to its initial condition thereby causing faces 56 and 58 to come into contact with the inner face of rim 67.

When it is desired to disengage the two box elements, the free or exposed end 53*a* of clasp 53, is pressed in such a way as to disengage the lugs 55 and 57 from inner face 67*b* of rim 67, after which element 40 may be withdrawn in the direction shown by the arrow in FIG. 11. As this is done, wing portions 60*c* and 61*c* of latches 60 and 61 come into contact with the chamfered edges 64*a* and 65*a* of rim 64 and 65, respectively, in such a way that the latches 60 and 61 are bent or pivoted around flexible parts or hinges 60*a* and 61*a*. Inasmuch as latches 60 and 61 are freely pivotable about hinge portion 60*a* and 61*a*, essentially no additional force is required to permit latches 60 and 61 to pass back through chamfered edges of rims 64*a* and 65*a* as the clasp is withdrawn from the housing.

It is believed that the advantages and improved results furnished by the method and apparatus of the present invention are apparent from the foregoing description of the preferred embodiment of the invention.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A fastening device comprising:

(A) a first element, adapted to be connected to a second element, said first element including an elongate member having:

(1) flexible, lateral sides each of which is provided with a boss, each of the bosses having an exterior edge positioned along an intermediate portion of each of said sides; and (2) an upper surface side provided with a lug located adjacent said bosses; and (B) a second element, adapted to be connected to said first element, including a hollow member having a front face in the form of an opening bordered by:

(1) opposite side rims, spaced apart by a distance at least as great as the width between said lateral sides of the elongate member but less than the distance between the exterior edges of the bosses, adapted to interact with said bosses, and (2) an upper rim adapted to interact with said lug to fasten said first element and said second element together when said elongate member is inserted into said hollow member so that the bosses and the lug pass by the rims.

2. A fastening device in accordance with claim 1, wherein said lug has a front surface and a rear surface, said front surface forming an oblique angle with said upper surface side and said rear surface being essentially perpendicular to said upper surface side.

3. A fastening device in accordance with claim 1, wherein each said boss has a front surface and a rear surface which incline in opposite directions towards each other and form oblique angles with each of said lateral sides.

4. A fastening device in accordance with claim 1, wherein each said boss is attached to a respective one of said lateral sides by a hinge.

5. A fastening device in accordance with claim 4, wherein each said boss is made up of a front wing portion having an exterior surface and an interior surface, and a rear wing portion having an exterior surface and an interior surface, connected so as to form an acute angle between the interior surface of said front wing portion and the interior surface of said rear wing portion and so that said exterior surface of said front wing portion abuts against a respective one of said opposite side rims and said exterior surface of said rear wing portion abuts against a respective one of said lateral sides thereby causing said lateral sides to bend inwardly towards each other to permit the bosses to pass by the side rims.

6. A fastening device in accordance with claim 1, wherein said hollow member is a housing made up of opposite lateral side portions connected to said opposite side rims, and an upper portion connected to said upper rim, said portions extending rearwardly away from said front face for a distance defining the depth of said housing.

7. A fastening device in accordance with claim 6, wherein said elongate member has a length greater than the depth of said housing so that a part of said elongate member remains outside said housing when said elongate member is inserted into said housing.

8. A fastening device in accordance with claim 1, wherein said upper rim has a chamfered lower edge facing outwardly and sloping downwardly to said opening to meet with an inner side of said upper rim.

9. A fastening device in accordance with claim 8, wherein said opposite side rims have chamfered edges sloping away from said opening.

10. A fastening device in accordance with claim 1, wherein said intermediate portion is narrower than a remaining portion of said lateral sides.

11. A fastening device in accordance with claim 10 wherein said lateral sides are separated from each other by a space.

12. A fastening device in accordance with claim 11, wherein said elongate member is generally U-shaped with two longitudinally extending branch portions each having an exterior side, an interior side and an upper side surface connected to a transverse base part, wherein said lateral sides form the exterior sides of the branch portions and a said lug is provided on each said upper surface side.

13. A fastening device in accordance with claim 12, wherein said base part forms a rear end of said elongate member.

14. A fastening device in accordance with claim 13, wherein said first element further includes a base member having a support surface and a means to support said elongate member attached to said elongate member at an end opposite said rear end.

15. A fastening device in accordance with claim 14, wherein said elongate member is attached to said means to support in a cantilever fashion.

16. A fastening device in accordance with claim 15, wherein said base member includes two sidewalls connected to said support surface and connected to a base surface located below said support surface to define an open-ended cavity.

17. A fastening device in accordance with claim 16, wherein said base member also includes at least one interior wall extending between said support surface and said base surface and positioned parallel to said side walls to divide said cavity in to at least two channels.

18. A fastening device in accordance with claim 17, wherein said base member also includes a rear plate having openings into said channels.

19. A fastening device in accordance with claim 16, wherein said second element further includes a bottom portion including a floor, two lateral walls connecting said floor with an upper surface to define an open-ended cavity, said hollow member being formed in said upper surface.

20. A fastening device in accordance with claim 19, wherein said two lateral walls are separated by a distance and said floor and said upper surface are separated by a distance respectively greater than a distance between said two side walls and a distance between said support surface and said base surface to permit said base member to nest within said bottom portion.

21. A fastening device in accordance with claim 20, wherein said first element and said second element are associated with complementary electrical devices.

22. An electrical connector device comprising:

(A) a first element attached to one component of an electrical device, adapted to be connected to a second element, said first element including:

(1) a base member having a support surface with a front end and a means to support extending perpendicularly from said support surface in the vicinity of said front end, (2) an elongate member having an end attached to said means to support, said elongate member having:

(a) flexible side components spaced apart from each other by a distance, each of said side components including:

(i) an exterior lateral side provided with a boss having an outer edge, and (ii) an upper surface side provided with a lug located adjacent said boss; and (B) a second element attached to another component of an electrical device, adapted to be connected to said first element, said second element including:

(1) a housing having:

(a) opposite side portions, (b) an upper portion extending between said side portions; and (c) a front face provided with an opening bordered by:

(i) opposite side rims connected to said opposite side portions, said opposite side rims being spaced apart by a distance at least as great as the distance between exterior lateral sides of said side components but less than the distance between outer edges of bosses provided on the exterior lateral sides, and adapted to interact with said bosses; and (ii) an upper rim connected to said upper portion, said upper rim being adapted to interact with lugs located on the upper surface side of the lateral sides, whereby interaction between the bosses and the opposite side rims and the lugs and the upper rim serve to connect said first element and said second element together when said elongate member is inserted into said housing in such a manner that said bosses and said lugs pass by said rims to become seated within said housing.

23. An electrical connector device in accordance with claim 22, wherein said lugs have a front surface and a rear surface, said front surface forming an oblique angle with said upper surface side and said rear surface being essentially perpendicular to said upper surface side.

24. An electrical connector device in accordance with claim 23, wherein said bosses have a front surface and a rear surface which incline in opposite directions towards each other and form an oblique angle with said exterior lateral side.

25. An electrical connector device in accordance with claim 23, wherein said bosses are attached to said exterior lateral side by a hinge.

26. An electrical connector device in accordance with claim 25, wherein each of said bosses are made up of a front wing portion having an exterior surface and an interior surface, and a rear wing portion having an exterior surface and an interior surface, connected so as to form an acute angle between the interior surface of said front wing portion and the interior surface of said rear wing portion, and so that said exterior surface of said front wing portion abuts against a respective one of said opposite side rims and said exterior surface of said rear wing portion abuts against a respective one of said lateral sides causing said lateral sides to bend inwardly towards each other to permit said bosses to pass by said rims.

27. An electrical connector device in accordance with claim 26, wherein said housing has a predetermined depth, and the elongate member has a predetermined length, which is greater than the depth of said housing so that at least a portion of said elongate member remains outside said housing when said elongate member is inserted into said housing.

28. An electrical connector device in accordance with claim 27, wherein said upper rim has a chamfered lower edge facing outwardly and sloping downwardly to said opening to meet with an inner side of said upper rim.

29. An electrical connector device in accordance with claim 28, wherein said opposite side rims have chamfered edges sloping away from said opening.

30. An electrical connector device in accordance with claim 29, wherein said base member includes two side walls connected to said support surface and connected to a base surface located below said support surface to define an open-ended cavity.

31. An electrical connector device in accordance with claim 30, wherein said base member also includes at least one interior wall extending between said support surface and said base surface and positioned parallel to said side walls to divide said cavity into at least two channels.

32. An electrical connector device in accordance with claim 31, wherein said base member also includes a rear plate having openings into said channels.

33. An electrical connector device in accordance with claim 32, wherein said second element further includes a bottom portion including a floor, two lateral walls connecting said floor with an upper surface to define an open-ended cavity, and a hollow member formed in said upper surface.

34. An electrical connector device in accordance with claim 33, wherein said two lateral walls are separated by a distance, and said floor and said upper surface are separated by a distance respectively greater than a distance between said two side walls and a distance between said support surface and said base surface to permit said base member to nest within said bottom portion.

35. An electrical connector device in accordance with claim 24, wherein said housing has a predetermined depth, and the elongate member has a predetermined length which is greater than the depth of said housing so that at least a portion of said elongate member remains outside said housing when said elongate member is inserted into said housing.

36. An electrical connector device in accordance with claim 35, wherein said upper rim has a chamfered lower edge facing outwardly and sloping downwardly to said opening to meet with an inner side of said upper rim.

37. An electrical connector in accordance with claim 36, wherein said opposite side rims have chamfered edges sloping away from said opening.

38. An electrical connector in accordance with claim 37, wherein said elongate member is generally U-shaped with said side components being connected to a transverse base portion and extending longitudinally to terminate in an end connected to said means to support.

39. An electrical connector device in accordance with claim 38, wherein said base member includes two side walls connected to said support surface and connected to a base surface located below said support surface to define an open-ended cavity.

40. An electrical connector device in accordance with claim 39, wherein said base member also includes at least one interior wall extending between said support surface and said base surface and positioned parallel to said side walls to divide said cavity to at least two channels.

41. An electrical connector device in accordance with claim 40, wherein said base member also includes a rear plate having openings into said channels.

42. An electrical connector device in accordance with claim 41, wherein said second element further includes a bottom portion including a floor, two lateral walls connecting said floor with an upper surface to define an open-ended cavity, and a hollow member formed in said upper surface.

43. An electrical connector in accordance with claim 42, wherein said two lateral walls are separated by a distance, and said floor and said upper surface are separated by a distance greater than a respective distance between said two side walls and a respective distance between said support surface and said base surface to permit said base member to nest within said bottom portion.

* * * * *

UNITED STATES PATENT AND TRADEMARK OFFICE

CERTIFICATE OF CORRECTION

PATENT NO. : 4,655,527

DATED : April 7, 1987

INVENTOR(S) : Bertrand VANDAME

It is certified that error appears in the above-identified patent and that said Letters Patent is hereby corrected as shown below:

At column 5, line 15, change "chamferred" to ---chamfered---.

At column 5, line 26, change "depress or squeeze" to ---depresses or squeezes ---.

At column 7, line 8, change "chamferred" to ---chamfered---.

At column 9, line 3, change "chamferred" to ---chamfered---.

Signed and Sealed this

Twenty-seventh Day of December, 1988

*Attest:*

DONALD J. QUIGG

*Attesting Officer*

*Commissioner of Patents and Trademarks*